United States Patent [19]

Sarfati

[11] Patent Number: 4,828,192

[45] Date of Patent: May 9, 1989

[54] THREAD FEEDER

[75] Inventor: Alberto G. Sarfati, Como, Italy

[73] Assignee: Sobrevin Société de Brevets industriels-Etablissement, Vaduz, Liechtenstein

[21] Appl. No.: 145,346

[22] Filed: Jan. 19, 1988

[30] Foreign Application Priority Data

Apr. 11, 1987 [EP] European Pat. Off. ..... 87105387.2

[51] Int. Cl.[4] ..... B65H 51/20

[52] U.S. Cl. ..... 242/47.01

[58] Field of Search ..... 242/47.01, 47.04, 47.05, 242/47.06, 47.07, 47.08, 47.09, 47.1, 47.11, 47.12, 47.13, 47, 128, 147 R, 149, 82; 66/132 R, 132 T; 139/452

[56] References Cited

U.S. PATENT DOCUMENTS

| | | | |
|---|---|---|---|
| 3,648,939 | 3/1972 | Rosen | 242/47.01 |
| 3,834,635 | 9/1974 | Pfarrwaller | 242/47.01 |
| 4,153,214 | 5/1979 | Savio et al. | 242/47.01 |

*Primary Examiner*—Stanley N. Gilreath

*Attorney, Agent, or Firm*—Martin A. Farber

[57] ABSTRACT

The invention concerns a thread feeder having a storage member (1) to which the thread (F) is tangentially fed and from which the thread (F) is removed overhead, the withdrawal being effected under elastic fingers (5) through a ring (6) which is provided in the region of the head end of the storage member (1). In order to obtain easy variability of the blocking of removal, fingers (5) seated on the storage member (1), extend protruding beyond the head end (4) of said member, and spring outward in the direction (x) of application against the ring (6) which is located beyond the head end (4).

11 Claims, 1 Drawing Sheet

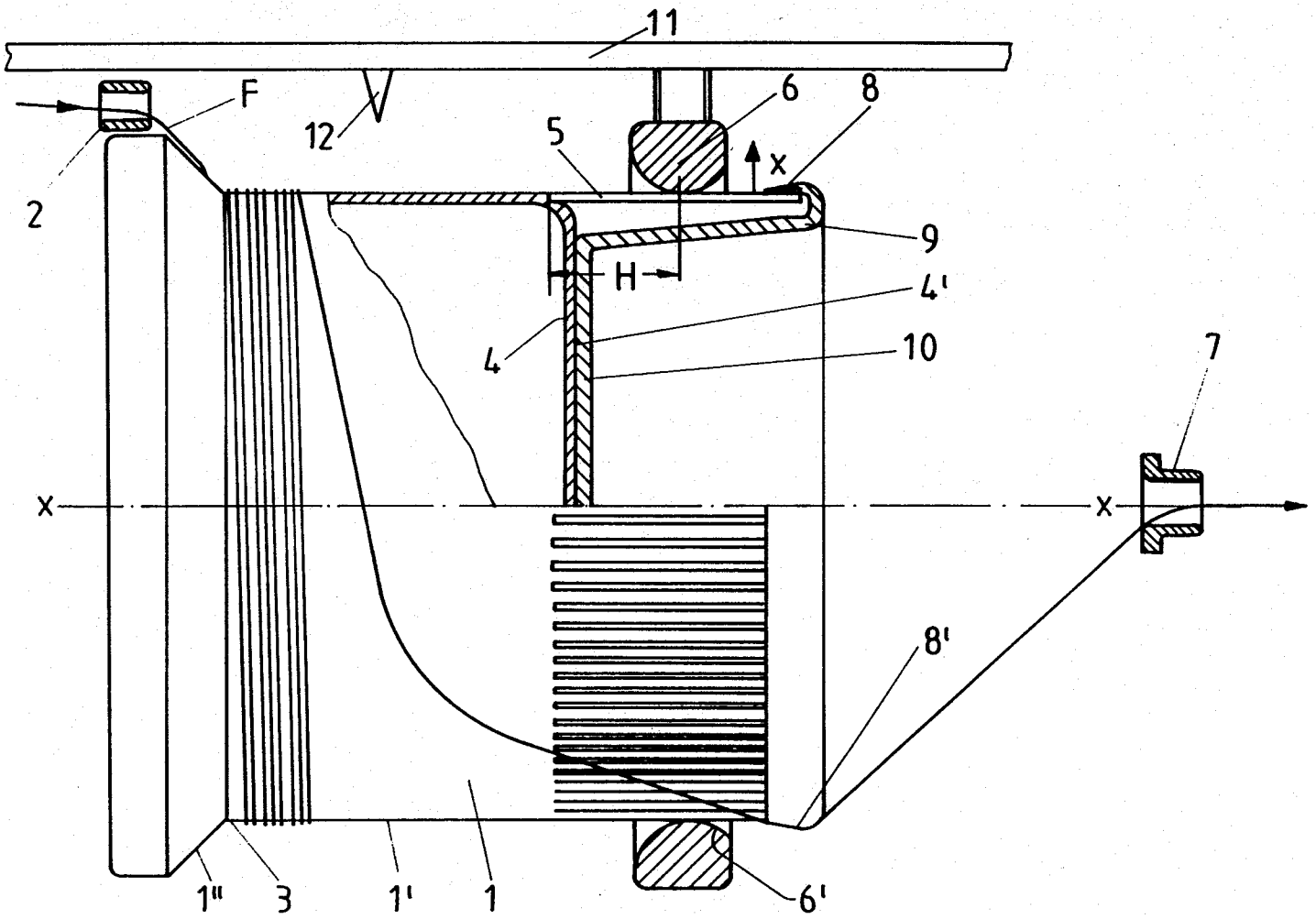
7
x
8
9
4'
10
8'
6
x
6'
11
H
5
4
1
1'
12
3
F
1''
2
x

THREAD FEEDER

FIELD AND BACKGROUND OF THE INVENTION

The present invention relates to a thread feeder.

In particular, the invention relates to a thread feeder having a storage member to which the thread is fed tangentially and from which the thread is withdrawn overhead, the withdrawal taking place through a ring provided in the region of the head end of the storage member under elastic fingers.

In the known feeders of this type (Federal Republic of Germany AS 19 00 619) the elastic fingers are seated on the ring. They extend inclined to the axis of the storage drum towards the cylindrical surface and rest thereon. The thread moves through the ring and slides under the fingers. This is intended, in particular, to make the thread withdrawal tension uniform.

This structural type is disadvantageous. Ring plus fingers form a relatively delicate plastic part. The secure position on the cylindrical surface of the drum cannot always be assured. In order to vary the preestablished removal tensions coming from the fingers, the rings must be replaced. This is not possible without a place of interruption of the thread since the thread must be pulled again through the ring.

SUMMARY OF THE INVENTION

It is an object of the invention to develop a device of the introductory-mentioned type in such a manner, that with a simplified and functionally reliable structural shape, ring and fingers are present as structural parts which are separate from each other.

According to the invention, the fingers are seated on the storage member, extend protruding beyond the head end of said member and spring outwards in the direction of application against the ring which is located beyond the head end.

As a result of this development, a thread feeder of the introductory-mentioned type is created which, with simple structural shape, assures greater reliability in operation and improved possibility of use. The elastic fingers are elements of the storage member and not of the ring. The ring is supported independently of the fingers in concentric position with respect to the storage member. Due to the fact that both the ring and the fingers cannot be brought out of their position of use by the withdrawn thread, they are absolutely reliable in function. Greater elastic forces can also be applied by the fingers, which results in a higher withdrawal tension and thus also in a relatively more uniform withdrawal tension of the thread.

If the fingers extend as an axial extension of the storage surface, the surface formed by them can possibly even be available for a short time as a storage surface.

The displaceability of the ring in the axial direction of the storage member permits the determination of the effective lever length of the fingers and thus the determination and variation of the pressing force of the fingers against the ring, which makes variation of the thread withdrawal tension possible.

In order to make the force which counteracts a deflection movement of the springs as large as possible but, on the other hand, limit the application force between fingers and ring, the annular collar is provided. The formation of the annular collar from the rim of a pot bent over in U shape also limits the possibilities of the inward springing of the fingers which results in the danger of damage, for instance upon transportation or the like; this also creates a structurally simple manner of effecting a variation here also, possibly by different pot elements. The fact that the fingers are integral with the storage member is of considerable advantage, particularly from the standpoint of manufacturing technique and stability. The conditions for the withdrawal of the thread are optimized, regardless of the position of the ring if the annular collar forms a ball-shaped thread slide surface on the outside. Regardless of where the ring is, the surface always remains in the same position.

According to a feature of the invention the fingers are formed in one piece with the storage member.

According to further features of the invention:

The fingers extend in the axial extension of the storage member cylindrical surface.

The ring is displaceable parallel to the axial direction of the storage member on a stationary support.

The upward resiliency of the fingers is limited by an annular collar.

The annular collar is arranged on a pot which is seated in front of the end surface of the storage member.

The rim of the pot is bent off in U shape and the ends of the fingers extend into the inner space thereof.

The fingers are seated rigidly on the storage member.

The annular collar forms an outer rounded thread slide surface.

BRIEF DESCRIPTION OF THE DRAWING

With the above and other objects and advantages in view, the present invention will become more clearly understood in connection with the detailed description of a preferred embodiment, when considered with the accompanying drawing.

The only figure of the drawing is a plan view partly in axial section of the thread feeder of the present invention.

DETAILED DESCRIPTION OF THE PREFERRED EMBODIMENT

The storage member 1, which is of circular cross section, has on its rear, adjoining its cylindrical surface 1', a frustoconical run-on surface 1''. The thread guide eye 2 moves in front of said surface. By relative rotary movement of the thread guide eye 2 with respect to the storage member 1 the thread F is fed in the region of the frustoconical surface 1''. It forces its way into the angular fillet 3 and thereby pushes the layers of thread which have been wound on just before tightly against each other in the direction towards the head end 4 of the storage member.

Protruding beyond the head end 4 there extend individual fingers 5 which come from the storage member 1. These fingers are developed with elastic spring action. They rest under initial spring tension, directed in the direction of the arrow x, with their wide sides against the ring 6. The ring 6 is rounded on its lower side 6'. The thread F is withdrawn through the inside of the ring 6 over the end of the storage member, preferably through a fixed eye 7.

The outward spring action of the fingers 5 is limited by an annular collar 8. The latter is formed by the end of the rim 9 of a pot 10 which is bent off in U shape. The pot is placed against the end surface 4' of the head end 4 of the storage member 1 and fastened there in suitable manner.

The ring 6 is seated on a support 11 for longitudinal displacement in axial direction x—x of the storage member 1. By this longitudinal-displacement adjustment the effective free lever arm H of the fingers can be varied and thus also the force of application in the direction of the arrow x and thus furthermore also the braking of the thread upon its withdrawal.

Upon this withdrawal the thread slides over the thread slide surface 8' of the annular collar 8. The latter is as smooth as possible and is rounded in the direction of withdrawal.

Upon the operation of the apparatus the thread is first of all stored in angular movement, namely by tangential feed onto the storage member 1, until a predetermined number of turns of thread are present. The transmitter of a photoelectric detector 12, for example, scans the cylindrical surface 1'. If the region of the preferably reflective cylindrical surface lying opposite it is covered by layers of thread then the further feeding of thread is stopped. If a withdrawal now takes place then this surface again becomes free and a corresponding switch device starts the feeding of the thread again. During operation the optimal thread withdrawal conditions can be established by displacement of the ring 6 and in this way therefore the properties of the material of the thread can even be taken into consideration.

I claim:

1. In a thread feeder having a storage member to which the thread is adapted to be fed tangentially and wound on an outer winding surface of the storage member, and from which the thread is adapted to be withdrawn over a head end of the storage member between a ring disposed in front of the head end of the storage member and elastic fingers, said ring being mounted displaceably in axial direction of said storage member to vary thread withdrawal tension, the improvement wherein said fingers each have a wide side and at one end of said fingers are mounted on the storage member, said fingers extend projectingly beyond the winding surface of said storage member in axial parallel extension of said outer winding surface, are formed as individual tongues resting with their respective wide side against an inner surface of the ring and are spring biased radially outwardly in a direction of resting application of their wide sides against said inner surface of the ring, and said fingers each have another, free end, and wherein an annular collar, disposed in front of said head end of the storage member, radially outwardly engages over said free ends of said fingers abuttingly limiting radially outward movement of said free ends of said fingers by their radially outward spring biasing, said annular collar forms an outer rounded thread slide surface over which said thread is adapted to be withdrawn, and said annular collar forms an inner space, said free ends of said fingers extend, freely and radially inwardly deflectable, into said inner space formed by the annular collar, said ring defines an effective free lever arm of the tongues between said one end and a point of resting of said wide side against the inner surface of said ring, whereby by displacement of the ring in the axial direction said effective free lever arm of the tongues is variable, whereby the spring biased tongues press against said ring with variable but substantially constant spring tension in all different axial positions of the ring and whereby braking force on the thread and thread withdrawal tension are variable without bending of the tongues.

2. The thread feeder according to claim 1, wherein said outer winding surface of said storage member is a cylindrical surface.

3. The thread feeder according to claim 1, further comprising a stationary support, and said ring is mounted displaceable in the axial direction of said storage member on said stationary support.

4. The thread feeder according to claim 1, further comprising a pot-shaped member seated on a front end surface of said head end of said storage member, and said annular collar is arranged on said pot-shaped member.

5. The thread feeder according to claim 4, wherein said pot-shaped member has a rim which is bent off in U shape forming said annular collar and said inner space inside said rim.

6. The thread feeder according to claim 5, wherein said another free ends of said fingers extend into said inner space inside said rim, and said inner space has a radial extent substantially greater than the thickness of said tongues.

7. The thread feeder according to claim 5, wherein the spring biasing of the tongues is an inherent spring biasing of the elasticity of the tongues themselves.

8. The thread feeder according to claim 5, wherein the inner surface of said ring is radially inwardly convexly curved so as to be engaged tangentially by said wide sides of said tongues.

9. The thread feeder according to claim 4, wherein said pot-shaped member is replaceably mounted on said storage member.

10. The thread feeder according to claim 1, wherein said fingers are seated rigidly on said storage member.

11. The thread feeder according to claim 1, wherein said fingers are formed in one piece with said storage member.

* * * * *